US008499417B1

(12) United States Patent
Lai

(10) Patent No.: US 8,499,417 B1
(45) Date of Patent: Aug. 6, 2013

(54) LUGGAGE HANDLE STRUCTURE

(71) Applicant: Wei Hung Lai, Taichung (TW)

(72) Inventor: Wei Hung Lai, Taichung (TW)

( * ) Notice: Subject to any disclaimer, the term of this patent is extended or adjusted under 35 U.S.C. 154(b) by 0 days.

(21) Appl. No.: 13/714,046

(22) Filed: Dec. 13, 2012

(51) Int. Cl.
*A47B 95/02* (2006.01)

(52) U.S. Cl.
USPC ..... 16/113.1; 16/429

(58) Field of Classification Search
USPC .. 16/113.1, 405, 429; 190/115, 18 A; 280/37, 280/655.1, 47.371; 220/762–764, 757
See application file for complete search history.

(56) References Cited

U.S. PATENT DOCUMENTS 5,502,876 A * 4/1996 Wang ..... 16/113.1
5,727,898 A * 3/1998 Lu ..... 403/325
6,128,806 A * 10/2000 Shou-Mao ..... 16/113.1
6,470,529 B1 * 10/2002 Chang ..... 16/113.1
6,802,409 B1 * 10/2004 Tiramani et al. ..... 190/18 A
6,918,475 B2 * 7/2005 Lin et al. ..... 190/115
7,886,404 B2 * 2/2011 Chen ..... 16/113.1
8,141,204 B2 * 3/2012 Chiang ..... 16/113.1

* cited by examiner

*Primary Examiner* — William Miller
(74) *Attorney, Agent, or Firm* — Muncy, Geissler, Olds & Lowe, PLLC

(57) ABSTRACT

A luggage handle structure includes a handle seat, a button, a press rod and an upper lid. Two ends of the handle seat are connected with retractable pull rods and control rods. The handle seat has two first holes, protruding walls surrounding the two first holes and limit troughs. The upper lid has two second holes and a through hole. The button and the press rod are mounted in the handle seat. The button extends out of the through hole. Through the design of the first and second holes, the luggage handle structure is light and saves the plastic material. The button is confined by the recess, the limit troughs and the protruding walls to press the press rods stably and to enhance the retractable pull rods so that the control rods and the retractable pull rods can be controlled exactly.

1 Claim, 6 Drawing Sheets

LUGGAGE HANDLE STRUCTURE

BACKGROUND OF THE INVENTION

1. Field of the Invention

The present invention relates to a luggage handle structure, and more particularly, to a luggage handle structure which is light and can save its material and can be operated stably.

2. Description of the Prior Art

As shown in FIG. 1, FIG. 2 and FIG. 3, a conventional luggage handle structure comprises a hollow handle seat 10. Two ends of the handle seat 10 are connected with retractable pull rods 12 and control rods 13. The handle seat 10 has an accommodation trough 11 to accommodate a button 16 with a press rod 15 and two auxiliary plates 17 disposed in the two ends thereof. An upper lid 14 is mounted on top of the handle seat 10. The upper lid 14 has a through hole 140 for the button 16 to extend therefrom. When the button 16 is pressed to link the press rod 15, the auxiliary plates 17 will be activated to press the control rods 13 to pull or position the retractable pull rods 12. The aforesaid structure has the following shortcomings.

1. The upper lid 14 and the handle seat 10 are hollow, so the button 16 with the press rod 15 cannot be confined well. Sometime, the press rod 15 may be deflected to cause an unbalance action. The luggage handle cannot be operated smoothly, so the accuracy of the control rods 13 to control the retractable pull rod 12 is bad. It is necessary to add the auxiliary plates 17.

2. The upper lid 14 and the handle seat 10 are a seal structure, so they use more plastic material and the cost is high.

3. The surfaces of the retractable pull rods 12 are flat, without a reinforcement structure, so they are not durable.

Accordingly, the present invention intends to provide a luggage handle structure for improving the shortcomings mentioned above.

SUMMARY OF THE INVENTION

The primary object of the present invention is to provide a luggage handle structure which comprises a handle seat, a button, a press rod and an upper lid. Two ends of the handle seat are connected with elliptic retractable pull rods and control rods. Each retractable pull rod has a plurality of grooves thereon. The handle seat has two first holes and protruding walls surrounding the two first holes to form two limit troughs and a recess between the two limit troughs. The recess is adapted to accommodate the button. The limit troughs are adapted to accommodate the press rod. The upper lid is coupled to the handle seat. The upper lid has two second holes and a through hole. The button extends out of the through hole. The handle seat and the upper lid have the first holes and the second holes to save the plastic material cost. The handle seat has the first holes and the protruding walls to form the recess and the limit troughs, such that the button and the press rod are confined to provide balance and stable effects when pressed, and the control rods and the retractable pull rods can be controlled exactly. The elliptic retractable pull rod has the plurality of grooves thereon to enhance its bending strength.

DETAILED DESCRIPTION OF THE PREFERRED EMBODIMENTS

Figure 1:
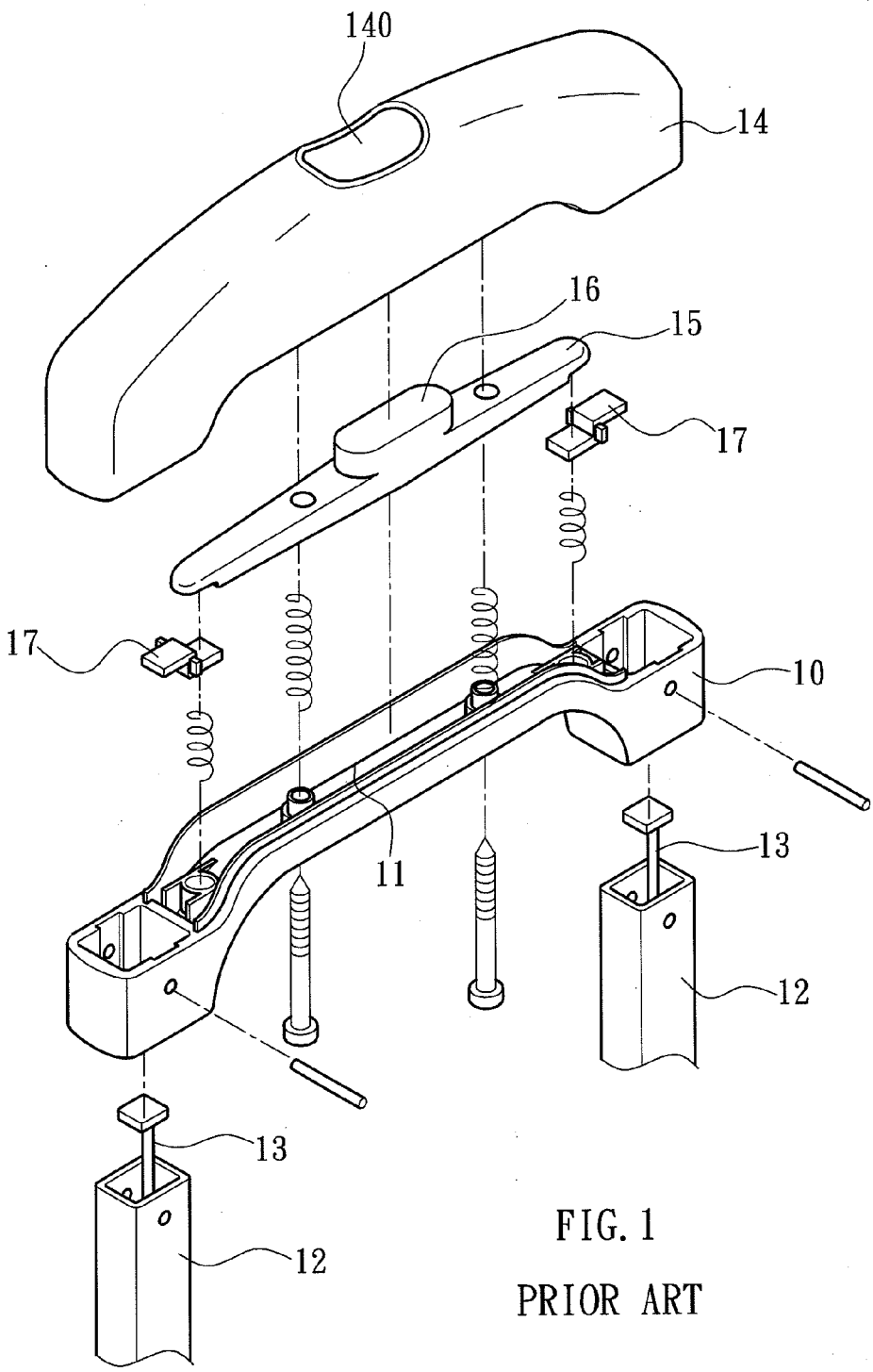
FIG. 1 PRIOR ART
FIG. 1 is an exploded view of a conventional luggage handle.
Figure 2:
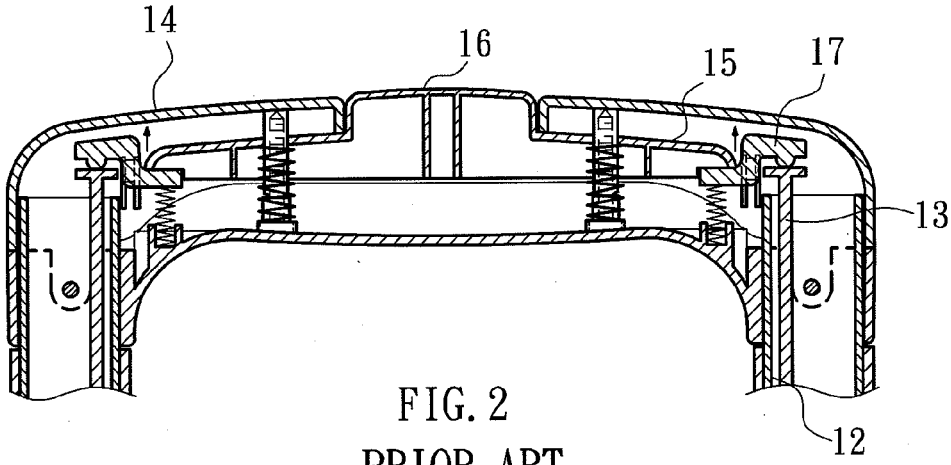
FIG. 2 PRIOR ART
FIG. 2 is a sectional view of the conventional luggage handle.
Figure 3:
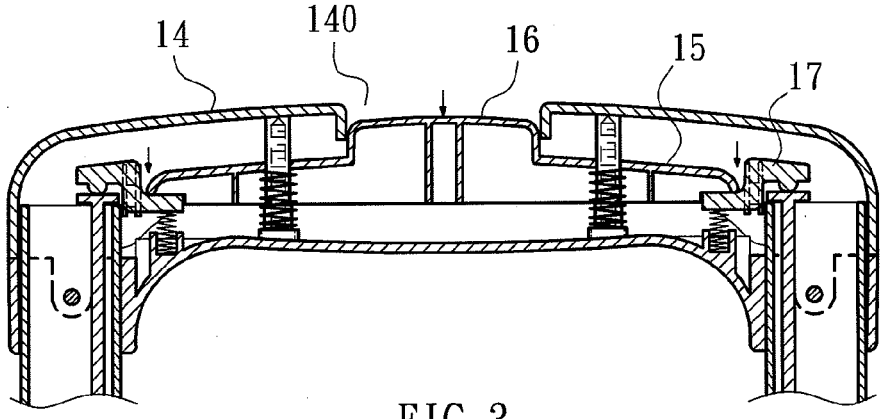
FIG. 3 PRIOR ART
FIG. 3 is a schematic view of the conventional luggage handle to show that the button is pressed downward.

Embodiments of the present invention will now be described, by way of example only, with reference to the accompanying drawings.

As shown in FIG. 4 to FIG. 8, the present invention comprises a handle seat 20, a button 28, a press rod 27 and an upper lid 30. Two ends of the handle seat 20 are connected with elliptic retractable pull rods 25 and control rods 26. Each retractable pull rod 25 has a groove 251 thereon. The handle seat 20 has two first holes 21 and protruding walls 22 surrounding the two first holes 21 to form two limit troughs 24 and a recess 23 between the two limit roughs 24. The limit troughs 24 are adapted to accommodate the press rod 27. The recess 23 is adapted to accommodate the button 28. The upper lid 30 has two second holes 31 and a through hole 32. The button 28 extends out of the through hole 32. The upper lid 30 is coupled to the handle seat 20.

Figure 5:
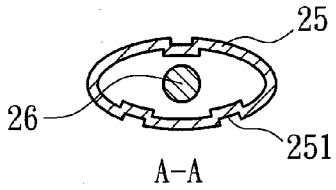
FIG. 5 is sectional view taken along line A-A of FIG. 1.
Figure 6:
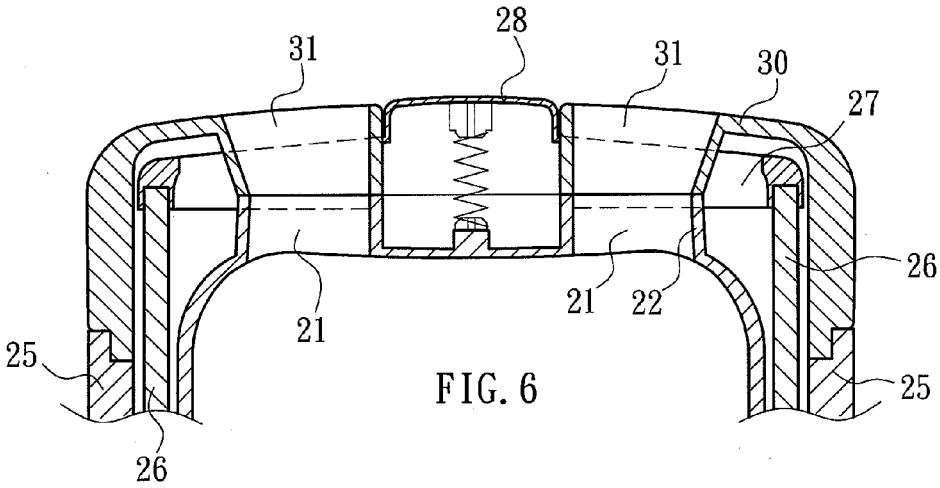
FIG. 6 is a front sectional view of the present invention.
Figure 7:
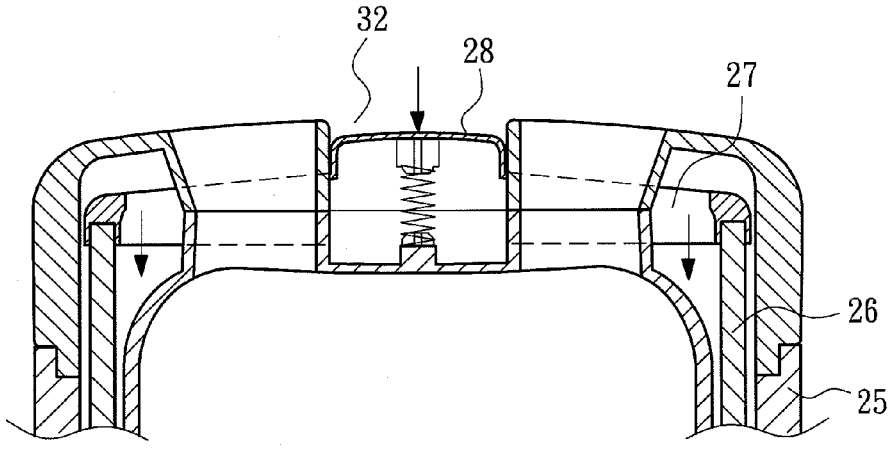
FIG. 7 is a schematic view of the present invention to show that the button is pressed downward.
Figure 8:
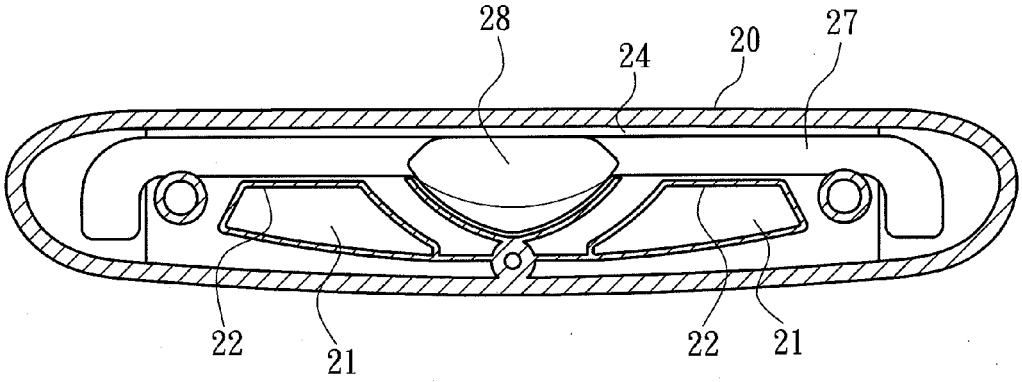
FIG. 8 is a top sectional view of the present invention.

According to the foregoing structure, the function and effect of the present invention are explained hereinafter. As shown in FIG. 5, FIG. 6 and FIG. 7, when the button 28 is pressed, the press rod 27 will be pushed downward to act the control rods 26, so that the retractable pull rods 25 can be pulled upward or downward. The present invention has the following effects.

Figure 4:
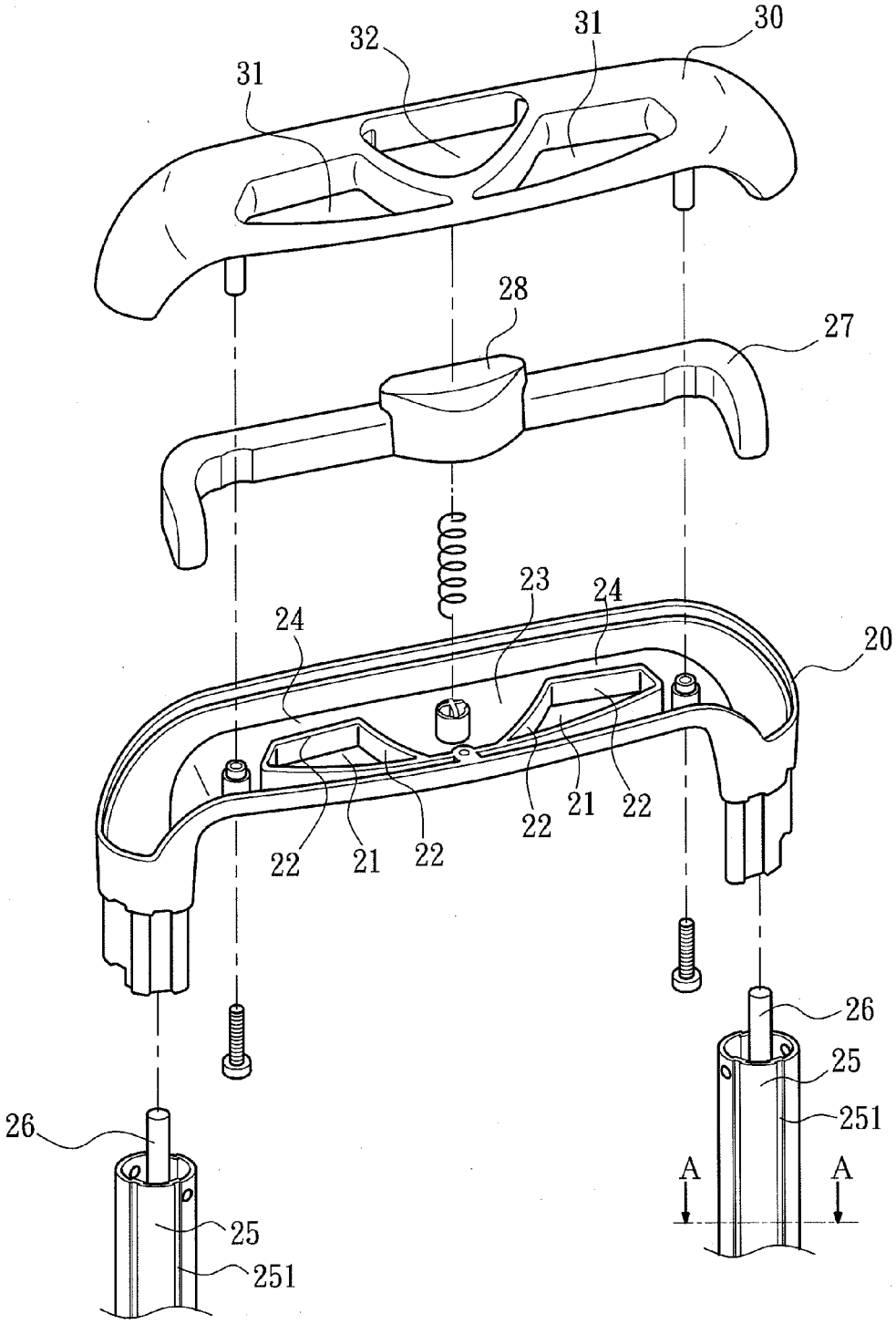
FIG. 4 is a perspective view of the present invention.

1. As shown in FIG. 4, the handle seat 20 and the upper lid 30 have the first holes 21 and the second holes 31 to save the plastic material cost.

2. As shown in FIG. 4 to FIG. 7, the handle seat 20 has the first holes 21 and the protruding walls 22 to form the recess 23 and the limit troughs 24, such that the button 28 and the press rod 27 are confined to provide balance and stable effects when pressed, and the control rods 26 and the retractable pull rods 25 can be controlled exactly.

Figure 9:
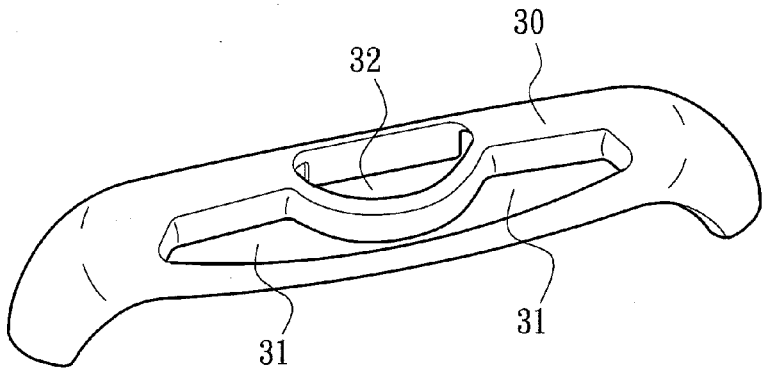
FIG. 9 is a perspective view of another embodiment of the present invention.
Figure 10:
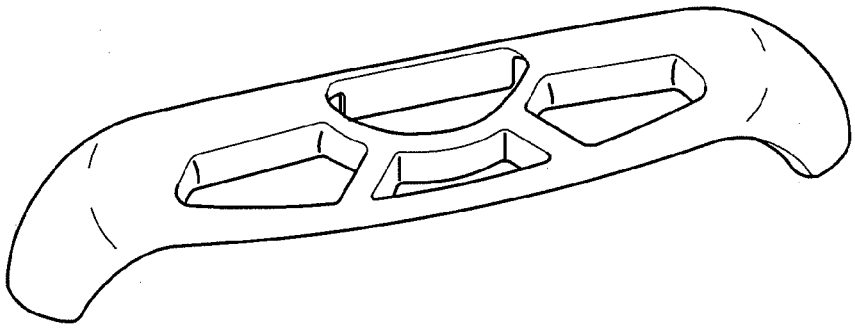
FIG. 10 is a perspective view of a further embodiment of the present invention.

3. In one embodiment, the two second holes 31 of the upper lid 30 can communicate with each other, as shown in FIG. 9, to save more material. In another embodiment, as shown in FIG. 10, the luggage handle structure may have several holes to save more material and the luggage handle structure is light.

4. As shown in FIG. 5, the elliptic retractable pull rods 25 may have a plurality of grooves 251 thereon to enhance its bending strength.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A luggage handle structure, comprising a handle seat, a button and integral press rod, and an upper lid, two ends of the handle seat being connected with elliptic retractable pull rods and control rods, each retractable pull rod having a plurality of grooves thereon, the handle seat having two first holes and protruding walls surrounding the two first holes to form two limit troughs and a recess between the two limit troughs, the recess receiving the button, the two limit troughs receiving the press rod, the upper lid being coupled to the handle seat, the upper lid having two second holes and a through hole, the button extending out of the through hole, the button and the press rod being confined by the recess, the limit troughs and the protruding walls to provide balance and stability thereto when pressed.

* * * * *